US006755882B2

(12) United States Patent
Otani et al.

(10) Patent No.: US 6,755,882 B2
(45) Date of Patent: Jun. 29, 2004

(54) METAL-GRAPHITE BRUSH

(75) Inventors: Takayoshi Otani, Mie (JP); Toshio Ishikawa, Aichi (JP); Mitsuo Ikeda, Mie (JP); Yoichi Sakaura, Mie (JP); Naoki Morita, Mie (JP)

(73) Assignee: Tris Inc. (JP)

( * ) Notice: Subject to any disclaimer, the term of this patent is extended or adjusted under 35 U.S.C. 154(b) by 28 days.

(21) Appl. No.: 10/279,639

(22) Filed: Oct. 24, 2002

(65) Prior Publication Data

US 2003/0094074 A1 May 22, 2003

(30) Foreign Application Priority Data

Oct. 25, 2001 (JP) ..... 2001-327536

(51) Int. Cl.[7] ..... C22C 1/04; H01R 39/20
(52) U.S. Cl. ..... 75/231; 310/249; 310/252
(58) Field of Search ..... 75/231; 310/249, 310/252

(56) References Cited

U.S. PATENT DOCUMENTS 3,601,645 A * 8/1971 Whiteheart ..... 310/219
5,270,504 A 12/1993 Grohs et al.
5,365,136 A * 11/1994 Deboves ..... 310/252
5,447,681 A * 9/1995 Tai Seung et al. ..... 419/36
5,701,046 A * 12/1997 Kammerer et al. ..... 310/251

FOREIGN PATENT DOCUMENTS

JP 2000-144202 A 5/2000

* cited by examiner

*Primary Examiner*—Ngoclan T. Mai
(74) *Attorney, Agent, or Firm*—Webb Ziesenheim Logsdon Orkin & Hanson, P.C.

(57) ABSTRACT

A brush body 4 of a metal-graphite brush 2 is composed of a Pb-less commutator side portion 6 which contains graphite, copper and a metal sulfide solid lubricant, and a lead side portion 8 which contains graphite, copper, the metal sulfide solid lubricant and Pb.

6 Claims, 4 Drawing Sheets

METAL-GRAPHITE BRUSH

FIELD OF THE INVENTION

The present invention relates to metal-graphite brushes which are used in electrical motors for automobiles, etc, and in particular, Pb-less metal-graphite brush.

PRIOR ART

Metal-graphite brushes have been used as brushes for low-voltage operation, such as brushes for electrical motors in automobiles. They are produced by mixing graphite and a metal powder such as copper powder, molding and sintering the mixture. As operated at low voltages, their resistivities are lowered by adding a low resistance metal powder. A metal sulfide solid lubricant, such as molybdenum disulfide or tungsten disulfide, and Pb are added to metal-graphite brushes in many cases. For example, in brushes for heavy load such as brushes for starting motor, Pb and a metal sulfide solid lubricant are added in most of the cases.

In recent years, Pb has been attracting greater attention as one of materials damaging to the environment, and there is a growing demand for Pb-less brushes. Of course, brushes containing no lead have been available up to the present and they have been used in some motors other than starting motors. Even some brushes for starting motors can be used by simply eliminating Pb from them, provided that they are used under normal service environments. To improve the lubricating properties without Pb, Japanese Patent Opening Hei 5-226048 (U.S. U.S. Pat. No. 5,270,504) proposes that a metal having a melting point lower than that of copper is mixed in such a way that copper and the metal do not form an alloy. The present inventors, however, found that in metal-graphite brushes wherein a metal sulfide solid lubricant is added to copper and graphite, the elimination of Pb results in an increase in the lead connection resistance under high temperature or high humidity.

SUMMARY OF THE INVENTION

The initial object of the present invention is to control the increase in the lead connection resistance of a so-called Pb-less metal-graphite brush under high temperature or high humidity.

In the present invention, a metal-graphite brush comprising a copper-graphite brush body to which a metal sulfide solid lubricant is added and a lead embedded in the copper-graphite brush body is characterized in that the brush body includes Pb in different concentrations between a neighborhood of the lead and a portion with which a commutator of a rotational electric armature is to be in contact in the brush body and that a concentration of Pb in the neighborhood of the lead is higher than a concentration of Pb in the portion.

Preferably, the brush body is molded of different powder materials in the Pb concentrations and the Pb concentration in the neighborhood of the lead in the brush body is 0.4–10 wt %.

More preferably, the different powder materials comprise a first powder material including 0.4–10 wt % Pb for the neighborhood of the lead and a second Pb-less powder material for the portion in contact with the commutator and the different materials are shaped in a common mold so that a tip of the lead is embedded in the neighborhood of the lead.

Preferably, the lead is added with Pb at least in a second portion embedded in the brush body and the brush body is molded of a Pb-less material.

Preferably, the metal sulfide solid lubricant is at least a member of a group comprising molybdenum disulfide and tungsten disulfide, and a concentration of the metal sulfide solid lubricant in the portion in contact with the commutator is 1–5 wt %. The metal sulfide solid lubricant is used to improve sliding when the brush contacts the commutator, and the concentration of the metal sulfide solid lubricant in the neighborhood of the lead is discretionary.

Preferably, a copper concentration in the neighborhood of the lead is higher than a copper concentration in the portion in contact with the commutator.

According to the present invention, an unleaded state or a state of substantially containing no lead does not mean a state being free of lead even as impurities. And a leaded state means that Pb is added intentionally and the Pb concentration is higher than the impurity level. The impurity level of Pb is normally 0.2 wt % or under.

According to the experiments by the present inventors, the increase in the lead connection resistance under high temperature or high humidity is attributed to the influences of the metal sulfide solid lubricant. When the metal sulfide solid lubricant was not added, the lead connection resistance did not increase substantially even under high temperature or high humidity. This is related to the presence or absence of Pb. When Pb was added, the lead connection resistance hardly increased. In Pb-less brushes, in correspondence with the increase in the lead connection resistance, the copper powder and the lead embedded in the brush body showed a greater tendency to be oxidized under high temperature or high humidity.

The metal sulfide solid lubricant such as molybdenum disulfide or tungsten disulfide is added by the designer of the brush, but the metal sulfide solid lubricant is indispensable to brushes so as to have a long service life. Without metal sulfide solid lubricant, an excessive wear may be generated. In particular, this phenomenon is conspicuous in starter brushes to which Pb has been added. When Pb and the metal sulfide solid lubricant are eliminated simultaneously, the service life of the brush will be reduced significantly. Hence in many cases, the metal sulfide solid lubricant can not be eliminated from Pb-less brushes.

The present inventors estimated the mechanism by which the metal sulfide solid lubricant accelerates the oxidization of the copper powder and the embedded lead under high temperature or high humidity as follows: At the time of sintering the brushes, sulfur is liberated from the metal sulfide solid lubricant added to the brush and sulfur adsorbs on the surface of copper to produce copper sulfide. If moisture acts on copper sulfide under high humidity, strongly acidic copper sulfate will be produced to corrode severely the copper powder and the lead. Although the behavior of copper sulfide under high temperature is not certain in some aspects, it is estimated that copper sulfide is oxidized to increase the electrical resistance.

The mechanism by which Pb prevents the oxidization of the copper powder in the brush and the embedded lead is not known exactly. The present inventors estimate that Pb contained in the brush partially evaporates at the time of sintering and coats the surface of copper in the form of a very thin Pb layer. And this Pb layer protects the inner copper from sulfate ion, etc.

According to the present invention, the Pb concentration in the neighborhood of the lead is higher than the Pb concentration in the remaining portion of the brush body, hence the increase in the lead connection resistance due to the metal sulfide solid lubricant under high temperature or high humidity can be prevented. Moreover, as the Pb concentration is lower in the portion of the brush body in contact with the commutator, the amount of Pb which is to be released into the environment can be reduced even when the brush body is worn down by contact and sliding against the commutator.

Such a brush can be produced easily by using two powder materials of different Pb concentrations, one for the neighborhood of the lead and the other for the remaining portion of the brush body, to mold the brush body. When the Pb concentration in the neighborhood of the lead is from 0.4 to 10 wt %, the increase in the lead connection resistance under high temperature or high humidity can be prevented effectively, and the initial value of the lead connection resistance will not increase.

In particular, when the brush body is formed out of two powder materials, one for the portion of the brush body in contact with the commutator and the other for the neighborhood of the lead, and they are molded integrally with the top end of the lead being embedded in the neighborhood of the lead, the production of the brush can be much more simplified. Furthermore, when the portion of the brush body in contact with the commutator is unleaded, the amount of Pb to be released into the environment can be reduced much more.

Instead, Pb may be added to at least the neighborhood of the lead to be embedded in the brush body so as to supply Pb from the lead to the interface between the embedding portion and the lead. Then the increase in the lead connection resistance can be prevented by Pb which is supplied by the lead to the interface.

The metal sulfide solid lubricant is, for example, molybdenum disulfide or tungsten disulfide, and when the addition of the metal sulfide solid lubricant in the portion of the brush body in contact with the commutator is from 1 to 5 wt %, good lubrication can be obtained.

When the copper concentration in the neighborhood of the lead is higher than the copper concentration in the commutator side portion, the lead connection resistance can be reduced.

It should be noted that even in Pb-less brushes, Pb is contained in electrolytic copper, which is normally used in metal-graphite brushes, as an impurity related to production, in many cases. Moreover, in the production process of brushes, if Pb-less brushes and leaded brushes are produced by using the same facilities, a small amount of Pb will enter, as a contamination, into the Pb-less brushes. However, when Pb is not added intentionally to a brush, the Pb concentration in the brush body will not generally exceed 0.2 wt %. Similarly, when a metal sulfide solid lubricant such as molybdenum disulfide or tungsten disulfide is added, contamination in the production process like that of Pb cannot be avoided, and a trace of the metal sulfide solid lubricant will be contained in some cases. However, in the case of contamination, the concentration of the metal sulfide solid lubricant will be 0.1 wt % or under in general.

EMBODIMENTS

Figure 1:
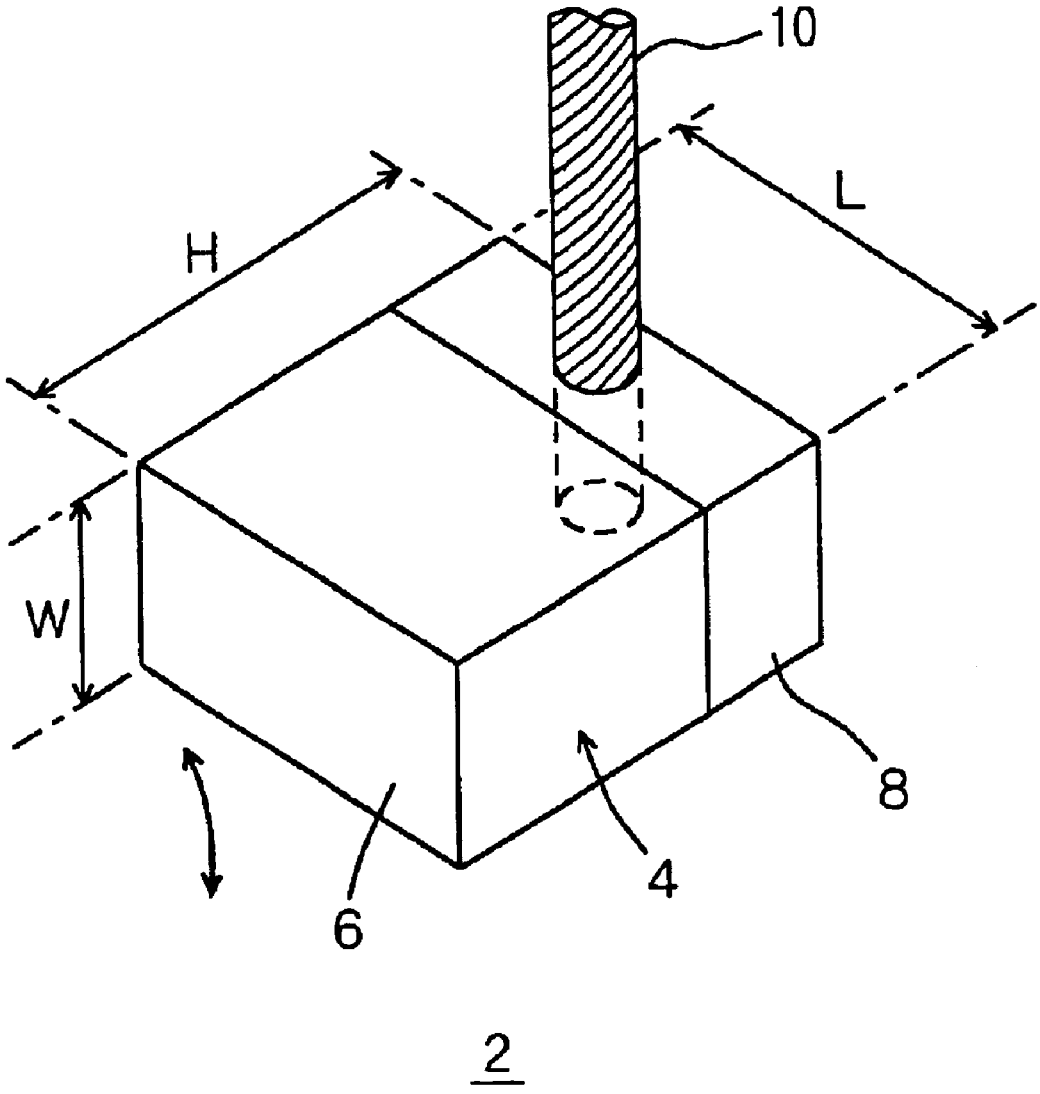
FIG. 1 is a perspective view of a metal-graphite brush of an embodiment.

FIG. 1 through FIG. 4 show the structure and the production method of the brush. FIG. 1 shows a metal-graphite brush 2 of the embodiment, and in the following, the metal-graphite brush is simply referred to as the brush. The brush is used, for example, as a brush of electrical motors in automobiles, such as a brush of a starting motor. 4 denotes a brush body. 6 denotes a commutator side portion, which makes sliding contact with the commutator of a rotational electric armature such as a starting motor. 8 denotes a lead side portion, in which a lead wire 10 is embedded and fixed. The sliding direction of the commutator is schematically shown by an arrow near the commutator side portion 6 in FIG. 1.

Both the commutator side portion 6 and the lead side portion 8 contain copper and graphite, and in addition to them, a metal sulfide solid lubricant is added to the commutator side portion 6. No lead is added to the commutator side portion 6. In addition to copper and graphite, Pb is added to the lead side portion 8. Addition of a metal sulfide solid lubricant to the lead side portion 8 is discretionary. The metal sulfide solid lubricant may be, for example, molybdenum disulfide or tungsten disulfide. When a metal sulfide solid lubricant is added to the commutator side portion 6, it is preferable to add 1 to 5 wt %. If the addition is less than 1 wt %, its lubricating effect will not be sufficient. If the addition is more than 5 wt %, the resistivity of the brush will increase. It should be noted that expressions such as "no addition" or "substantially not included" indicate that the content of Pb or the content of a metal sulfide solid lubricant is below the impurity level. The impurity level of Pb is about 0.2 wt %, and the impurity level of a metal sulfide solid lubricant is 0.1 wt % or under.

The Pb concentration in the lead side portion 8 is from 0.4 to 10 wt %; if it is less than 0.4 wt %, it cannot prevent the increase in the lead connection resistance, and if it exceeds 10 wt %, it increases the lead connection resistance from the beginning. As mentioned above, the principal cause of the increase in the lead connection resistance is the presence of sulfur in the metal sulfide solid lubricant. However, even if the metal sulfide solid lubricant is not added to the lead side portion 8, sulfate ion comes from the commutator side portion 6, and the metal sulfide solid lubricant at the impurity level in the lead side portion 8 has some effects. Hence 0.4 to 10 wt % of Pb is added to the lead side portion 8.

When the interface between the commutator side portion 6 and the lead side portion 8 is not definite, for example, the brush 2 is cut and the Pb concentration in the brush material near the interface between the lead wire 10 and the brush body is defined as the Pb concentration in the lead side portion. As for the copper concentration in the brush material, when the copper concentration in the lead side portion 8 is made higher than that in the commutator side portion 6, the lead connection resistance can be reduced. The lead wire 10 may be a copper wire electroplated with nickel or silver or the like. In the embodiment, however, a copper lead wire, which is made by stranding nonelectroplated copper wires, is used because oxidization by the metal sulfide solid lubricant can be prevented efficiently.

In the case of the brush, Pb poses a problem because Pb will be released into the environment due to sliding and wear of the brush. In the embodiment, Pb is not added to the commutator side portion and Pb is added only to the lead side portion. Accordingly, lead will not be released due to wear of the brush and will not pose the environmental problem.

Figure 2:
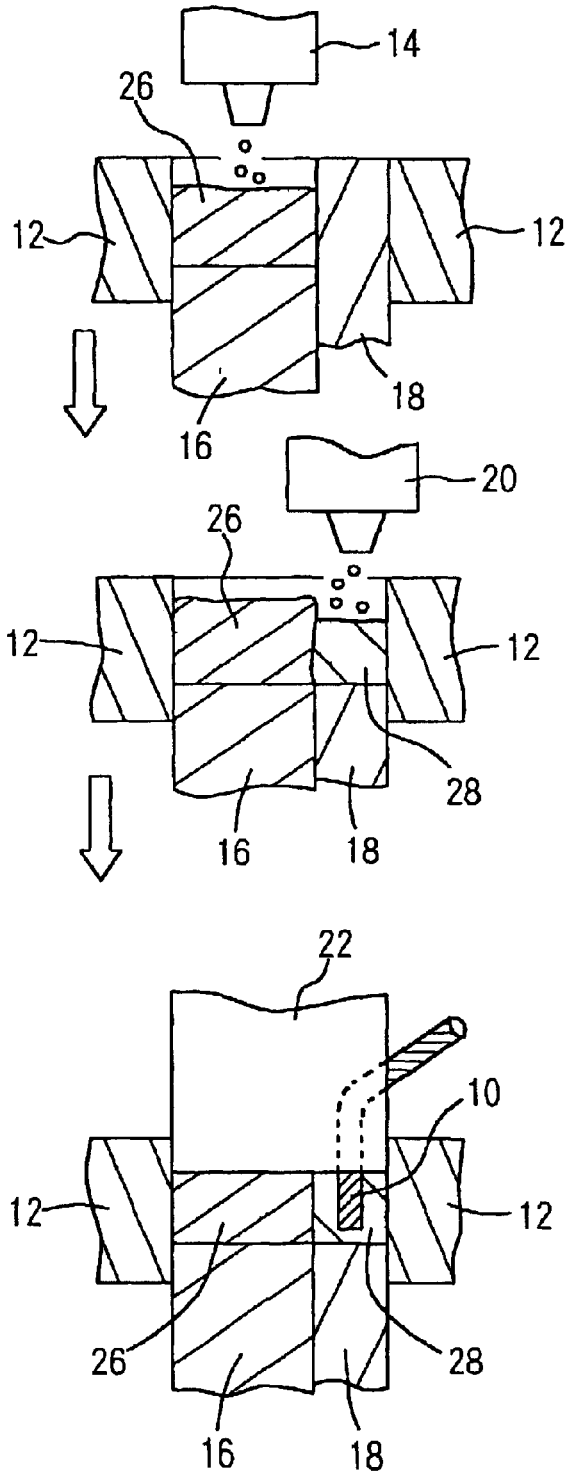
FIG. 2 shows schematically the molding process of the metal-graphite brush of the embodiment.

The production of the brush 2 is done, for example, as shown in FIG. 2. A fixed die 12 is provided with, for example, a pair of lower movable dies 16, 18. A portion corresponding to the lead side portion is first blocked by the lower movable die 18. Then a Pb-less powder material 26 for the commutator side portion is fed from a first hopper 14. Next, the lower movable die 18 is retracted, and a leaded powder material 28 for the lead side portion is fed from a second hopper 20. Then an upper movable die 22 with the lead wire 10 being drawn out of the top end thereof is lowered so as to embed the top end of the lead wire 10, then integral molding is effected. In this way, both the commutator side portion and the lead side portion are molded integrally, and at the same time the top end of the lead wire is molded. When the molding is sintered in a reducing atmosphere or the like, the brush 2 will be obtained.

Figure 3:
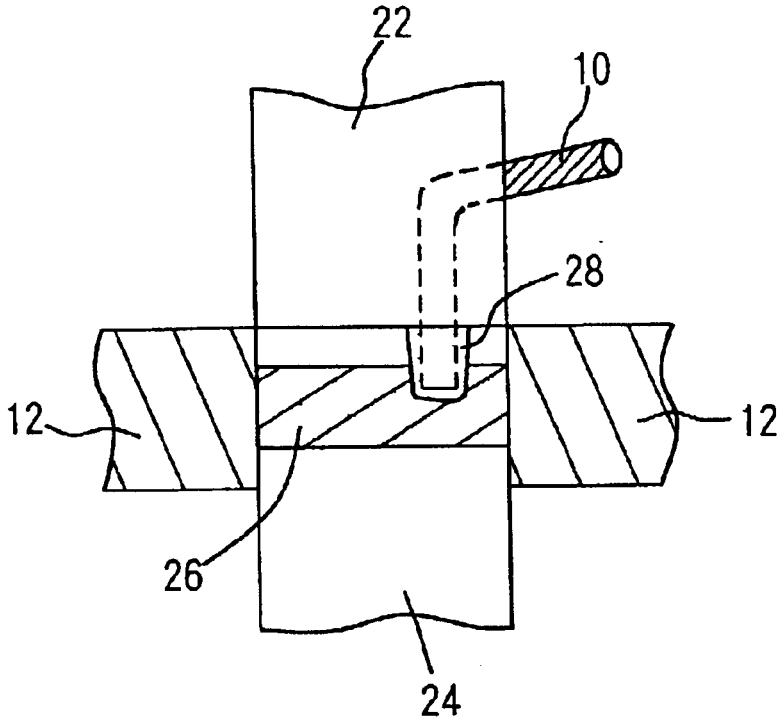
FIG. 3 shows the molding process of the metal-graphite brush of a modification, where a lead to which a lead side powder material is pre-adhered is embedded into a powder material for a commutator side portion.

FIG. 3 shows the production of the brush of the modification. The Pb-less powder material 26 is fed onto a lower movable die 24 from a hopper not illustrated. Next, the lead wire 10 with the leaded powder material 28 adhering to an embedded portion thereof is embedded by the upper movable die 22 into the powder material 26, and simultaneously with this, the powder material 26 and the lead wire 10 are pressed by the upper movable die 22 to be molded integrally. To make the powder material 28 adhere to the lead wire 10, for example, a mixed powder of graphite and copper powder is dispersed in a phenol resin binder solution or the like, and the embedded portion of the lead wire 10 is immersed in the solution.

Figure 4:
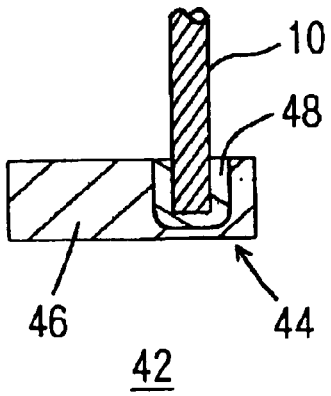
FIG. 4 is a sectional view of the metal-graphite brush of the modification.

FIG. 4 shows a metal-graphite brush 42 obtained by the manner as shown in FIG. 3. 44 denotes a brush body, 46 denotes a commutator side portion, and 48 denotes a lead side portion. Of course, the configuration and the method of production of the brush themselves are discretionary.

In the following, the embodiment will be described more specifically. The configuration of the brush is one shown in FIG. 1. The height H of the brush body 4 is 13.5 mm, the length L thereof is 13 mm, and the width W thereof is 6.5 mm. The lead wire 10 is a stranded nonelectroplated copper wires. It may be a braided wire. The diameter of the lead wire 10 is 3.5 mm, and the depth of its embedded portion is 5.5 mm. The ratio of the height of the commutator side portion 6 and that of the lead side portion 8 is, for example, about 3:2.

Embodiment 1

Twenty parts by weight of novolak type phenol resin being dissolved in 40 parts by weight of methanol were mixed with 100 parts by weight of natural flaky graphite. They were mixed up by a mixer homogeneously, and methanol was dried out of the mixture by a drier. The residue was crushed by an impact crusher and sieved with a sieve of 80 mesh pass (a 198 $\mu$m pass sieve) to obtain resin finished graphite powder. Sixty parts by weight of electrolytic copper, of which mean particle size was 30 $\mu$m, and 3 parts by weight of molybdenum disulfide were respectively added to 37 parts by weight of the resin finished graphite powder. They were homogeneously mixed by a V type mixer to obtain the powder material 26 for the commutator side portion. 69.5 parts by weight of electrolytic copper, of which mean particle size was 30 $\mu$m, and 0.5 part by weight of fine Pb powder were added to 30 parts by weight of the resin finished graphite, and they were homogeneously mixed by the V type mixer to obtain a powder material 28 for the lead side portion. These powder materials were integrally molded under the pressure of $4\times10^8$ Pa ($4\times9800$ N/cm$^2$), as shown in FIG. 2, and the molding was sintered in a reducing atmosphere in an electric furnace at 700° C. to obtain the brush of embodiment 1.

Embodiment 2

66.5 parts by weight of electrolytic copper, of which mean particle size was 30 $\mu$m, 3 parts by weight of molybdenum disulfide, and 0.5 part by weight of fine Pb powder were added to 30 parts by weight of the resin finished graphite which was used in embodiment 1. They were homogeneously mixed in the V type mixer to obtain a powder material 28. The powder material 26 for the commutator side portion was the same as that of embodiment 1, and other conditions were the same as those of embodiment 1. After molding and sintering, the brush of embodiment 2 was obtained.

Embodiment 3

One part by weight of fine Pb powder was added to 100 parts by weight of the powder material 26 for the commutator side portion, which was used in embodiment 1, and the mixture was mixed by the V type mixer homogeneously to obtain the powder material 28. The powder material 26 was the same as one that was used in embodiment 1. And other conditions were the same as those of embodiment 1. After molding and sintering, the brush of embodiment 3 was obtained. In the case of this brush, the Pb-less powder material 26 is prepared for the commutator side portion, and when Pb is added to it, the powder material 28 for the lead side portion will be obtained. Thus the mixing is easy.

COMPARATIVE EXAMPLE 1

Sixty parts by weight of electrolytic copper, of which mean particle size was 30 $\mu$m, and 3 parts by weight of molybdenum disulfide were added to 37 parts by weight of the resin finished graphite which was used in embodiment 1. They were homogeneously mixed in the V type mixer to obtain a Pb-less powder material. This powder material was used, without any change, for both the commutator side portion and the lead side portion, namely, for the entire brush. The powder material was molded under the pressure of $4\times10^8$ Pa and the molding was sintered in a reducing atmosphere in an electric furnace at 700° C. to obtain a brush of comparative example 1. This brush was a Pb-less brush, which was produced by the conventional ordinary brush production method.

The contents of the metal sulfide solid lubricant and Pb in each of the above-mentioned brushes, on calculation, increase a little in comparison with the concentrations based on the mixing because the novolak type phenol resin is partly decomposed and lost at the time of sintering. The calculated increases, however, are within the margin of error. Table 1 shows the contents of Pb and the metal sulfide solid lubricant in the lead side portions of embodiments and the comparative example. Zero percent (0%) content in Table 1 indicates that the material is not added and substantially it is not contained and does not indicate the content of the impurity.

TABLE 1

Contents of Pb and the metal sulfide solid lubricant in the lead side portions

| Sample | MoS2 content (%) | Pb content (%) |
|---|---|---|
| Embodiment 1 | 0 | 0.5 |
| Embodiment 2 | 3.1 | 0.5 |
| Embodiment 3 | 3.1 | 1.0 |
| Comparative example 1 | 3.1 | 0 |

Brushes of embodiments 1 through 3 and comparative example 1 were put in an electric oven at 200° C. and forced to be oxidized, and their lead connection resistances were measured periodically. Changes in the lead connection resistances resulting from the exposure to 200° C. are shown in Table 2. Furthermore, brushes of embodiments 1 through 3 and comparative example 1 were put in a constant-temperature & constant-humidity vessel of 80° C. and relative humidity of 85% to expose them to the high humidity and force copper therein to be oxidized, and their lead connection resistances were measured periodically. The changes in the lead connection resistances in the high humidity are shown in Table 3. The number of measurements was ten for each, and the arithmetic mean was used. The measurement of the lead connection resistance was made in accordance with "Method of testing the lead connection resistance of brushes for electrical machines" described in Japan Carbon Association Standards, JCAS-12-1986.

TABLE 2

Changes in lead connection resistances resulting from exposure to 200° C.

| Sample | Lead connection resistance (unit: mV/10A) | | | | | | | | |
|---|---|---|---|---|---|---|---|---|---|
| Number of days | Initial value | 1 | 2 | 3 | 4 | 5 | 7 | 10 | 15 |
| Embodiment 1 | 0.75 | 0.78 | 0.80 | 0.82 | 0.86 | 0.88 | 0.92 | 0.98 | 1.09 |
| Embodiment 2 | 0.76 | 0.80 | 0.86 | 0.92 | 0.96 | 0.99 | 1.06 | 1.09 | 1.12 |
| Embodiment 3 | 0.86 | 0.88 | 0.90 | 0.92 | 0.94 | 0.96 | 0.98 | 1.03 | 1.11 |
| Comparative example 1 | 0.85 | 0.96 | 1.23 | 1.33 | 1.42 | 1.52 | 1.65 | 1.96 | 2.33 |

TABLE 3

Changes in lead connection resistances resulting from exposure to 80° C. and relative humidity of 85%

| Sample | Lead connection resistance (unit: mV/10A) | | | | | | | | |
|---|---|---|---|---|---|---|---|---|---|
| Number of days | Initial value | 1 | 2 | 3 | 4 | 5 | 7 | 10 | 15 |
| Embodiment 1 | 0.84 | 0.91 | 0.96 | 1.00 | 1.02 | 1.09 | 1.12 | 1.33 | 1.42 |
| Embodiment 2 | 0.82 | 0.88 | 1.00 | 1.02 | 1.06 | 1.12 | 1.16 | 1.29 | 1.38 |
| Embodiment 3 | 0.81 | 0.89 | 0.95 | 1.01 | 1.07 | 1.11 | 1.18 | 1.31 | 1.39 |
| Comparative example 1 | 0.83 | 1.68 | 3.01 | 4.56 | 6.32 | 8.21 | 11.23 | 20.45 | 31.20 |

Comparative example 1 is the conventional Pb-less brush. This brush showed a significant increase in the lead connection resistance in the high humidity, and it also showed an increase in the lead connection resistance at the high temperature. The tests described above were acceleration tests for obtaining results in a shorter time. Hence the exposure conditions, namely, humidity of 85% and temperature of 80° C. provided a severe temperature environment. In high humidity, however, the brush undergoes oxidization even at lower temperatures, and the lead connection resistance increases similarly after exposure over a long period. In the brushes of embodiments 1 through 3, however, the lead connection resistances hardly increased in similar acceleration tests.

In the brushes of the embodiments, no lead was added to the commutator side portions 6 which were subjected to sliding and wear. Hence no lead will be released into the environment to cause contamination. Moreover, the rise in the lead connection resistance can be prevented. The embodiments used addition of molybdenum disulfide as example, but the problem is sulfur compounds such as copper sulfate, which are generated by molybdenum disulfide and the problem is identical when tungsten disulfide is added.

Embodiment 2

Figure 5:
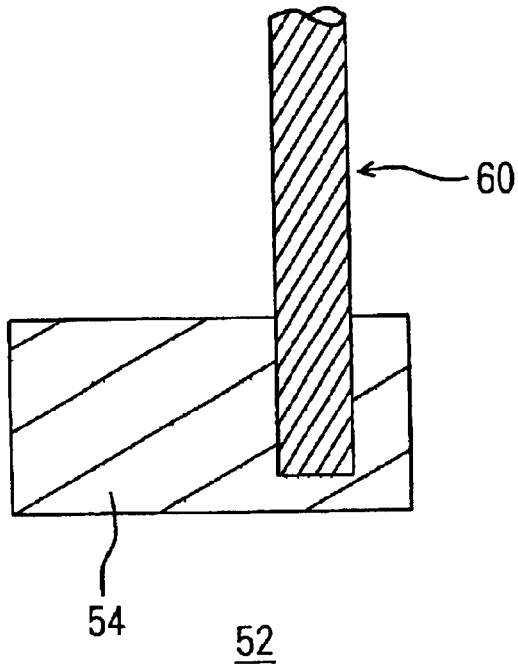
FIG. 5 is a sectional view of the metal-graphite brush of the second embodiment.
Figure 6:
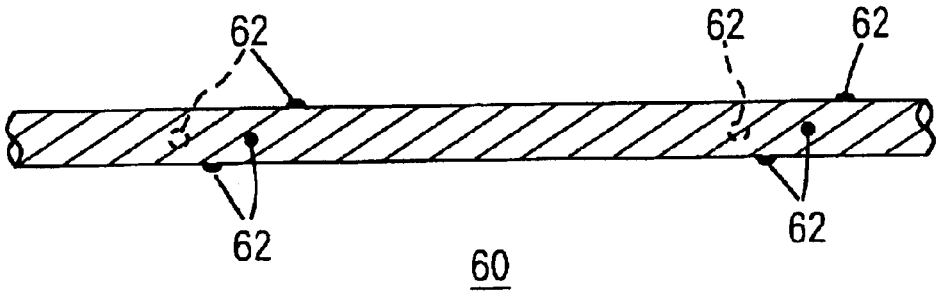
FIG. 6 shows schematically the lead wire used in the second embodiment.

FIG. 5 and FIG. 6 show the second embodiment. 52 denotes a new metal-graphite brush. The brush body 54 is entirely formed out of a Pb-less powder material 26. A lead wire 60, which is a stranded or braided wire of copper, is spotted with lead solder cream by a dispenser or a head of an ink jet printer. The spots are used as Pb sources 62. The Pb sources 62 are provided on a portion of the lead wire 60, the portion being to be embedded in the brush body 54. For example, spots are located on the lead wire 60 in the direction of its length at a plurality of points, for example, 3 or 4 points, on its circumference.

The lead wire 60 having the Pb sources 62 is used to mold and sinter the brush 52 in the manner similar to that of the conventional brush. In the course of sintering, lead solder cream of the Pb sources 62 evaporates or diffuses to coat the surface of the lead wire 60, it also diffuses, through the interface between the lead wire 60 and the brush body, into the metal-graphite of the brush body to coat the surfaces of copper powder in the metal-graphite. In this embodiment, Pb is locally added to the lead wire 60 and the metal-graphite at the interface between the lead wire 60 and the brush body, and like the above-mentioned respective embodiments, the increase in the lead connection resistance under high temperature or high humidity can be prevented. As an alternative to this, a copper lead wire or the like, of which portion to be embedded in the brush body is electroplated with Pb, may be used.

What is claimed is:

1. A metal-graphite brush comprising a copper-graphite brush body to which a metal sulfide solid lubricant is added and a lead embedded in the copper-graphite brush body wherein said brush body includes Pb in different concentrations between a neighborhood of the lead and a portion with which a commutator of a rotational electric armature is to be in contact in said brush body and that a concentration of Pb in the neighborhood of the lead is higher than a concentration of Pb in said portion.

2. A metal-graphite brush of claim 1, wherein said brush body is molded of different powder materials in the Pb concentrations and that the Pb concentration in the neighborhood of the lead in the brush body is 0.4–10 wt %.

3. A metal-graphite brush of claim 2, wherein said different powder materials comprise a first powder material including 0.4–10 wt % Pb for the neighborhood of the lead and a second Pb-less powder material for said portion in contact with the commutator and said different materials are shaped in a common mold so that a tip of the lead is embedded in said neighborhood of the lead.

4. A metal-graphite brush of claim 1, wherein said lead is added with Pb at least in a second portion embedded in said brush body and said brush body is molded of a Pb-less material.

5. A metal-graphite brush of claim 1, wherein the metal sulfide solid lubricant is at least a member selected from the group consisting of molybdenum disulfide and tungsten disulfide, and a concentration of the metal sulfide solid lubricant in said portion in contact with the commutator is 1–5 wt %.

6. A metal-graphite brush of claim 1, wherein a copper concentration in said neighborhood of the lead is higher than a copper concentration in said portion in contact with the commutator.

* * * * *